US005104229A

United States Patent [19]

Paul

[11] Patent Number: 5,104,229

[45] Date of Patent: Apr. 14, 1992

[54] METHOD AND APPARATUS FOR BLENDING AND WITHDRAWING SOLID PARTICULATE MATERIAL FROM A VESSEL

[75] Inventor: Kermit D. Paul, Allentown, Pa.

[73] Assignee: Fuller Company, Bethlehem, Pa.

[21] Appl. No.: 304,471

[22] Filed: Feb. 1, 1989

[51] Int. Cl.[5] ..... B01F 5/24

[52] U.S. Cl. ..... 366/101; 366/348; 366/341

[58] Field of Search ..... 311/341, 177, 137, 336, 311/348, 101, 107, 106

[56] References Cited

U.S. PATENT DOCUMENTS

| | | | |
|---|---|---|---|
| 2,884,231 | 4/1959 | Pyle et al. . | |
| 3,273,864 | 9/1966 | Thomson, Jr. . | |
| 3,275,303 | 9/1966 | Goins | 366/341 X |
| 3,386,707 | 6/1968 | Brown . | |
| 3,592,446 | 7/1971 | Leva . | |
| 4,068,828 | 1/1978 | Goins . | |
| 4,408,889, | 10/1983 | Peschl | 366/341 X |
| 4,412,748 | 11/1983 | Wohnhas et al. | 366/341 |
| 4,478,517 | 10/1984 | Hoppe et al. | 366/101 |
| 4,534,655 | 8/1985 | King | 366/137 |
| 4,560,285 | 12/1985 | Fisher | 366/341 |
| 4,660,988 | 4/1987 | Hara et al. | 366/137 |
| 4,818,117 | 4/1987 | Krambrock | 366/341 |
| 4,818,499 | 4/1987 | Chantriaux et al. | 366/137 |

FOREIGN PATENT DOCUMENTS

| | | | |
|---|---|---|---|
| 1217756 | 3/1966 | Fed. Rep. of Germany | 366/341 |
| 3520265 | 10/1986 | Fed. Rep. of Germany | 366/341 |
| 855809 | 12/1960 | United Kingdom | 366/101 |
| 2187652 | 9/1987 | United Kingdom | 366/341 |

*Primary Examiner*—Frankie L. Stinson
*Attorney, Agent, or Firm*—Daniel DeJoseph

[57] ABSTRACT

A method and apparatus is provided for blending solid particulate material in a vessel which includes a center lift column and a first downcomer channel which includes n successive vertical sections and n flow ports respective located at a top portion of the n sections. The n sections include withdrawal structure for providing a volumetric outlet flow rate which includes a flow rate contribution from each of the n sections which is 1/n of the outlet flow rate. The apparatus can also include a second channel which includes a plurality of vertically spaced inlets for receiving particulate material from different vertical locations within a blending vessel of the apparatus and an outlet for returning particulate material to the lower part of the vessel, with each of the inlets of the second channel including a baffle extending into an internal flow area of the channel. A discharge spout is connected to the outlet of the second channel and recycles a portion of the particulate material at the outlet to the power part of the vessel and withdraws another part of the particulate material at the outlet to a conveying line outside the vessel.

23 Claims, 4 Drawing Sheets

METHOD AND APPARATUS FOR BLENDING AND WITHDRAWING SOLID PARTICULATE MATERIAL FROM A VESSEL

FIELD OF THE INVENTION

This invention relates to a material blending system which employs either or both a bottom or a top fill technique for solid particulate material, such as plastic pellets, and which employs withdrawal and recycle channels (downcomers) in a gravity flow system.

BACKGROUND OF THE INVENTION

Material blenders are known which include a vertically oriented vessel with a centrally mounted lift column for recirculating material within the vessel. Typical examples of such blenders are shown, for example, in U.S. Pat. Nos. 3,276,753; 3,642,178; and 4,194,845.

Gravity type blenders include a vertically oriented vessel with a plurality of downcomers each having inlets at various levels in the vessel. Material in the upper part of the vessel enters the downcomers and flows into a receiving bin or hopper so that material from various levels in the vessel are mixed. In some instances, a material recirculation system is provided. Typical examples of such blenders are shown for example in U.S. Pat. Nos. 3,158,362; 3,216,629; 3,421,739 and 4,068,828.

Apparatus utilizing a bottom fill technique with a central lift column for blending solid particulate material such as plastic pellets are generally shown in U.S. Pat. No. 4,569,596 and U.S. patent application Ser. No. 680,213 filed Dec. 10, 1984, now U.S. Pat. No. 4,573,800, both assigned to the assignee of the present invention. In this type of system, the material to be blended is pneumatically conveyed from a source of material to the bottom of the blender and the energy utilized for conveying the material to the blender is used to lift the material up the central lift column while also entraining material already in the vessel and lifting the same, along with the fresh material, to the top of the vessel and, thereby, blending the material. Top fill techniques are also known in the art.

In order to improve the supply of material from the top of the vessel to the lift column, attempts have been made to utilize recirculation channels or internal downcomers in combination with a central lift or blending column. One such arrangement is shown in U.S. Pat. No. 3,386,707 issued June 4, 1968.

In blenders utilized for blending solid particulate material such as plastic pellets which utilize a gravity type apparatus for recirculating material, it is known that if a vertical recycle channel or downcomer is placed in the blending vessel and that recycle channel includes a plurality of vertically spaced apart openings along its length, material will normally only flow into the channel from the uppermost opening which is buried by the material in the vessel. Thus, despite the several openings in the channel, material only flows into the uppermost opening down through the channel to the outlet of the channel. Once the level of material in the vessel falls below an opening in the recirculating channel, then material will start flowing into the channel in the next lower opening.

It is known from U.S. Pat. Nos. 4,560,285 issued Dec. 24, 1985; 4,068,828 issued Jan. 17, 1978 and 3,216,629 issued Nov. 9, 1965, that, if a baffle is placed in the channel opening, then there will be flow of material into the channel not only from the uppermost channel inlet, but also in all lower channel inlets which include baffles. As used in a gravity type blender, this creates the ability to withdraw material from not only the uppermost point in the vessel, but also from a lower point to thereby improve blending efficiency.

With prior practice, such as illustrated in the above referenced patents, recirculation of the material is typically through an external means whereby material is withdrawn through the channels, supplied to a pneumatic conveying system, and recirculated outside the vessel to the top of the vessel for further blending.

U.S. patent application Ser. No. 848,005, filed Apr. 3, 1986 and assigned to the assignee of the present invention, discloses a vertically oriented vessel with a plurality of recycle channels circumferentially spaced around the inside of the vessel. Each of these channels has a plurality of vertically spaced apart inlet openings each with an adjustable baffle positioned therein. The vessel includes a tubular extension extending downwardly at the bottom of the vessel. A centrally mounted lift or blending column is mounted in the vessel and extends into the tubular extension to define a seal leg. Particulate material to be blended may be supplied either into the top of the vessel or in the preferred form, into the bottom of the vessel for passage directly upwardly through the vertical lift column using the energy used to supply the material to the blender. Material already in the vessel moves by gravity down through the recycle channels to the area of the seal leg for entrainment with incoming material up through the blending column. The outlets of the recycle channels are placed near the top of the seal leg and the inlet for the lift column is placed near the bottom of the seal leg.

The means for controlling the flow of material into the recycle channels includes a moveable flow controlled deflector which may be positioned between extreme positions of extending into the channel or extending out of the channel into the vessel. By the present invention, it has been discovered that if the moveable deflector extends into a channel, material will flow into that channel from both the uppermost opening in the channel and a lower opening. If the moveable deflector extends out of the channel, then material will not flow into that opening unless it is the uppermost opening in the channel. A valve means may be placed in each recycle channel to control flow of material through that channel.

The subject matter of each of the above-noted patents and patent applications is incorporated by reference herein.

In continuous blending systems, it is customary to withdraw blended product from a single location (elevation) within the blender bed. The concentration of ingredients of the effluent then becomes a function of the relative location of the feed and withdrawal points as well as elapsed time. It would, however, be advantageous to withdraw product from a plurality of locations (elevations) within the blender bed.

SUMMARY OF THE INVENTION

It is a principal object of this invention to provide a downcomer system in a continuous blending system which is capable of transporting product from a plurality of locations (elevations) within the blender bed to more closely approach the performance of a perfect blender than a single point system.

It is another object of this invention to provide a downcomer channel having different vertical sections each of which contribute approximately equal percentages of the total outlet flow from the channel or alternatively contribute predetermined percentages as desired, which may be different for the various vertical sections in accordance with use requirements.

It is yet another object of this invention to provide a blending system employing a first downcomer channel as described above in combination with a second downcomer channel including a plurality of vertically spaced withdrawal ports and a baffle associated with each withdrawal port to enhance the quality of blending resulting from the different flow rates in various sections of the first and second downcomer channels at the same elevations.

It is still another object of this invention to provide a dual function recycle/withdrawal nozzle or conduit means for use with the above-described first and second downcomer channels.

According to the invention, there is provided an apparatus for blending and withdrawing solid particulate material from a vessel, including a first downcomer channel associated with the vessel and including an outlet at a bottom portion thereof, the first channel comprising n successive vertical sections and n flow ports respectively located at top portions of the n sections, and at least two of the n sections having different flow areas from one another. In one embodiment, all of the n sections have different flow areas from one another. Also, the n sections can have flow areas which are progressively smaller from a bottommost one to a topmost one of the n sections. The n sections can include means for providing a volumetric outlet flow rate at the outlet of the first channel which includes a flow rate contribution from each of the n sections which is 1/n of the outlet flow rate. The bottommost one of the n sections can have an internal flow area A, with each subsequent vertical one of the n sections having an internal flow area smaller by A/n than a below adjacent one of the n sections. The invention can further include a second downcomer channel associated with the vessel and including a plurality of vertically spaced inlets for receiving particulate material from the different vertical sections located within the vessel and an outlet at a bottom portion thereof, with each of the inlets of the second channel including a baffle means extending into an internal flow area of the second channel. The apparatus can further include a conduit means connected to the outlet of the second channel comprising means for directing a portion of the particulate material at the outlet to the lower part of the vessel and means for withdrawing another portion of the particulate material at the outlet to a conveying line outside the vessel. The conduit means can further include a first rectangular conduit positioned to receive material from the outlet of the second channel, with the means for withdrawing comprising a second rectangular conduit connected to the first conduit to intercept particulate material flowing down the first conduit along a section extending from one side to an opposite side of the first conduit in a direction which is substantially the same as the direction in which the baffle means extend into the second channel, and with the means for directing comprising a third rectangular conduit connected to the first conduit to intercept a remaining portion of the particulate material to recycle it to the lower part of the vessel. The conduit means can alternatively be connected to the first channel.

Also according to the invention, there is provided an apparatus for blending and withdrawing solid particulate material, which includes (1) a vertically oriented vessel having an upper part, a lower part, an inlet for particulate material to be blended, an outlet for blended particulate material, and a tubular extension at the lower part, (2) a vertical lift column centrally mounted in the vessel, having a lower part extending into the tubular extension, and including an inlet within the tubular extension and an outlet in the upper part of the vessel, (3) means for supplying gaseous fluid under pressure to the tubular extension below the lift column for entraining material in the tubular extension into the inlet of the lift column and upwardly through the lift column whereby material is discharged from the outlet of the lift column in a geyser-like manner into the upper part of the vessel, the tubular extension and the lift column being dimensioned to define a seal leg to enable a major portion of the gaseous fluid to be directed upwardly through the lift column, and (4) a first downcomer channel associated with the vessel and having an outlet at a bottom portion thereof, with the first channel comprising n successive vertical sections and n flow ports respectively located at a top portion of the n sections, and with at least two of the n sections having flow areas different in size from one another.

According to the invention, there is also provided a discharge spout for withdrawing and/or recycling solid particulate material from a vessel. The discharge spout is adapted to be connected to an outlet of a downcomer channel. The discharge spout includes a means for recycling a portion of the particulate material at the outlet to the lower part of the vessel and means for withdrawing another portion of the particulate material at the outlet to a conveying line outside the vessel. The means for recycling can include a first rectangular conduit, and the means for withdrawing can include a second rectangular conduit connected to the first conduit to intercept particulate material flowing down the first conduit along a section extending from one side to an opposite side of the first conduit in a direction coextensive with the direction in which the baffle means extend into the channel.

Also according to the invention, there is provided a method of blending and withdrawing solid particulate material from an apparatus which includes a downcomer channel means including a first downcomer channel having n successive vertical sections and n flow ports respectively located at a top portion of the n sections, the method including providing an outlet flow from the first channel including predetermined percentage contributions from the n sections. The method can further include causing the n sections to contribute approximately equal percentages of the outlet flow from the channel. The method can also include providing the downcomer means with a second downcomer channel and moving particulate material down the first channel and to the second channel from the same starting elevation at different speeds so as to enhance blending within the apparatus.

BRIEF DESCRIPTION OF THE DRAWINGS

The above and other objects, advantages and features of the invention will be more fully understood when considered in conjunction with the following discussion and the attached drawings, of which.

DESCRIPTION OF THE PREFERRED EMBODIMENTS

Figure 1:
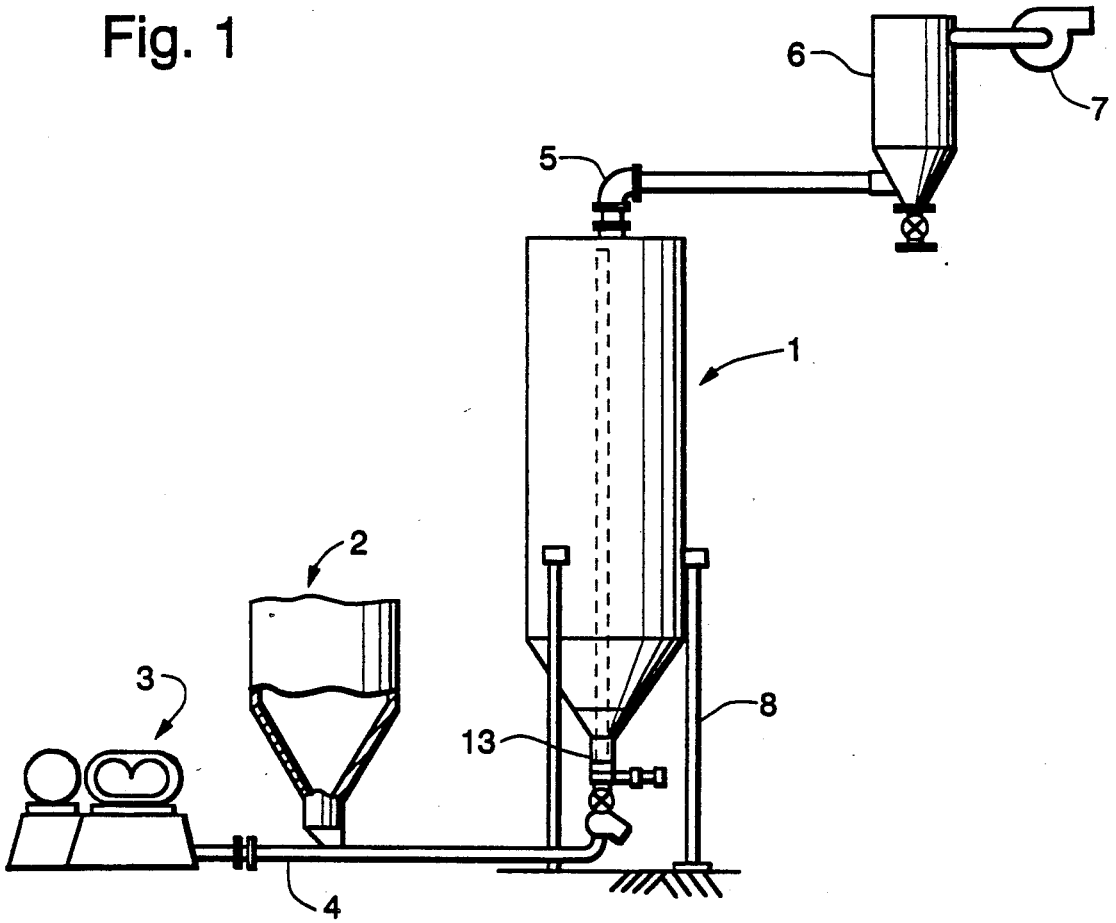
FIG. 1 is a diagrammatic view of the blending system according to the present invention.

Referring to FIG. 1, the blending system according to the present invention includes a blender generally indicated at 1, a source of particulate material to be blended indicated at 2 and a source of gaseous fluid under pressure such as a motor operated blower 3. It should be noted that blender 1 could alternatively be loaded via a pressure differential or vacuum technique by drawing material from source 2 by means of, for example, a pressure differential between blender 1 and source 2. A conduit 4 extends between blower 3 and inlet 13 of blender 1 for supplying gaseous fluid under pressure and entrained fresh material to be blended from source 2 to blender 1. Material from source 2 is supplied to conduit 4 by any of the several means known in the pneumatic conveying art. A similar system is disclosed in U.S. Pat. No. 4,569,596.

Figure 2:
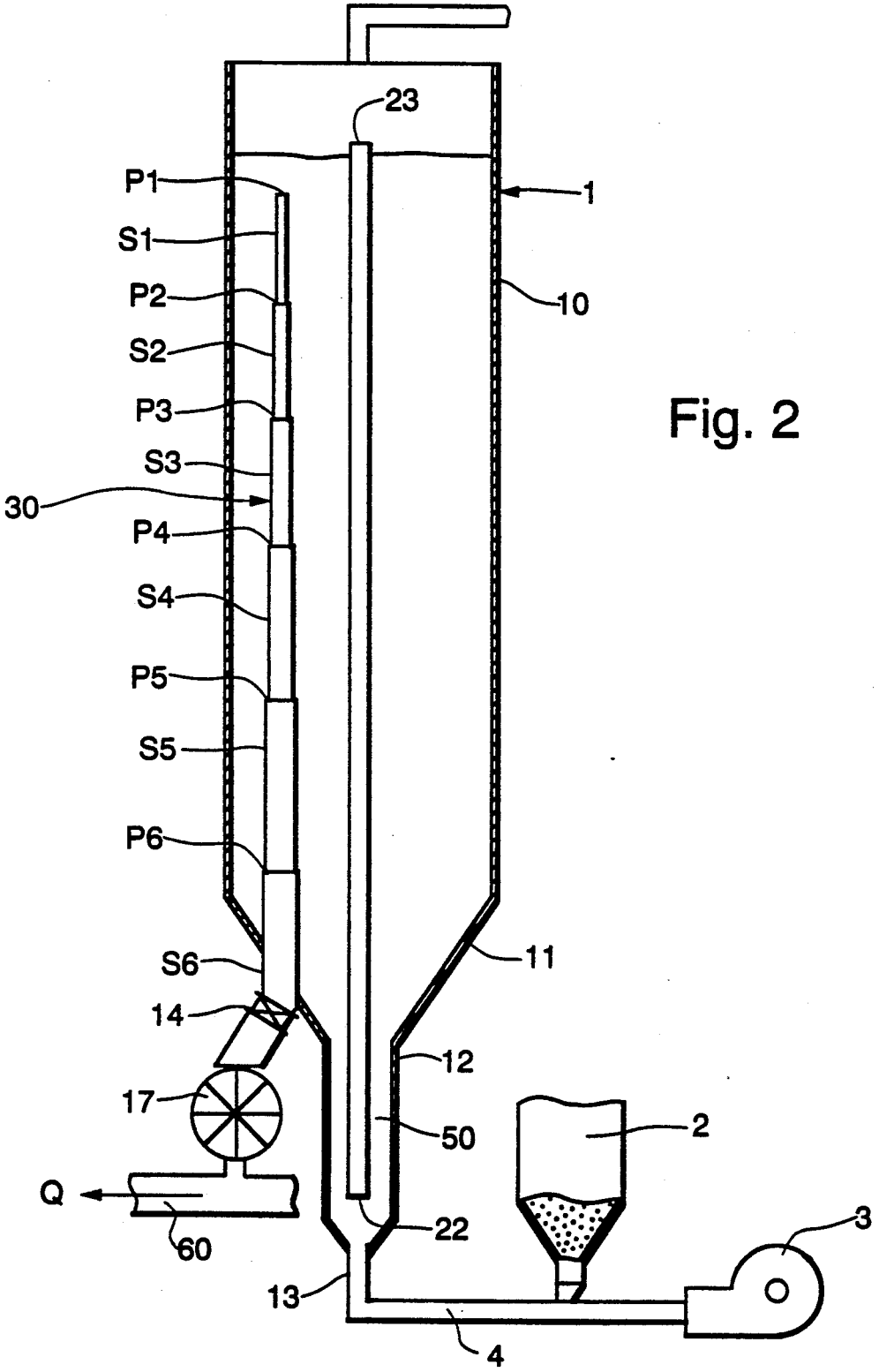
FIG. 2 is a sectional view of a blending apparatus according to a first embodiment of the present invention.

Referring to FIG. 2, blender 1 includes a vertically oriented vessel 10 having a hopper shaped bottom or lower end 11 and a downwardly extending tubular extension 12 centrally positioned in the lower part of vessel 10. In the preferred form, vessel 10 includes a solid particulate material inlet 13 in the bottom of tubular extension 12. Inlet 13 is connected to conveying conduit 4. When it is desired to supply material to blending vessel 10, material is supplied from source 2 by entrainment in the gaseous fluid under pressure supplied from blower 3 and conveyed through line 4 to inlet 13.

While in the preferred form the invention includes a bottom inlet for material to be blended, it should be understood that the invention is also applicable to a blender where material is supplied to the top of the vessel and blending is achieved totally by material recirculation within the blender to be hereinafter described.

Vessel 10 includes a vertically oriented, centrally mounted blending or lift column 20 which extends downwardly into tubular section 12 as illustrated in FIG. 2. This blending column or lift column 20 is mounted in the vessel 10 by means of support brackets (not shown). Column 20 is hollow and open ended and has a lower end 22 near opening 13 within tubular extension 12 and an upper end or outlet 23 which is near the top of vessel 10. A plurality of downcomer channels as shown in above-mentioned U.S. patent application Ser. No. 848,005 filed Apr. 3, 1986, can be employed for internal mixing.

The blending apparatus also includes at least one downcomer channel 30 within vessel 10. While this downcomer channel has been illustrated as being inside of vessel 10, it should be understood that it is contemplated according to the present invention that channel 30 may be positioned outside of the vessel with suitable inlets and outlets connected to the inside of the vessel. Channel 30 may be positioned within the vessel at any of various points such as at the periphery of the vessel.

Channel 30 is segmented in that it includes a plurality of sections S1–S6. In the FIG. 2 embodiment, at the top portion of each of sections S1–S6 are located flow ports P1–P6, respectively. The internal flow areas of the sections S1–S6 have predetermined sizes such that the flow rate contribution from each of the sections S1–S6 is determined by the relative cross sectional areas of the sections S1–S6. According to the invention, the cross sectional areas of at least two of the sections S1–S6 are different from each other, but these cross sectional areas can all be different from each other. According to one embodiment, the internal flow area of each subsequent section S1–S6 decreases by 1/6 of the flow area of the outlet section S6. In other words, if outlet section S6 has a flow area A1, section S5 has a flow area 5A1/6, S4 a flow area 2A1/3, S3 a flow area A1/2, S2 a flow area A1/3 and S1 a flow area A1/6. As a result, the volumetric flow rate which enters at the flow ports at each elevation is 1/6 of the total outlet flow rate. While the illustrated embodiment shows a channel 30 having six sections S1–S6, it should be noted that any number n greater than one could be employed. With n sections, the internal flow area of each subsequent section increases by 1/n the flow area of the outlet section. Also, a plurality of channels 30 can be employed. The various sections S1–S6 and channel 30 as a whole are secured to the inside of vessel 10 by means of brackets (not shown).

At the bottom of channel 30 is provided a conduit system which includes a valve 14 which, when closed, enables repair/maintenance work to be performed on rotary valve 17 and, when open, allows the particulate material to pass through rotary valve 17 and then into a withdrawal conveying line 60.

Figure 3:
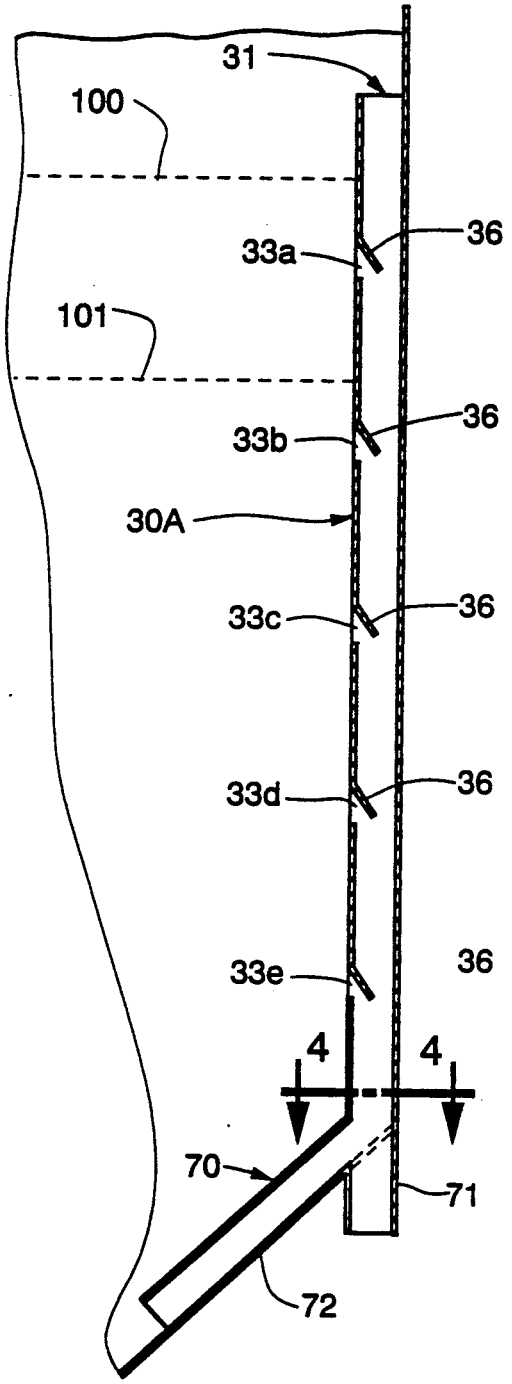
FIG. 3 is a sectional view of a second embodiment of the apparatus according to the present invention.

FIG. 3 illustrates a non-segmented downcomer channel 30A which, in the illustrated embodiment, has a square or rectangular shape and is shown positioned within a blender 1 such as that of FIGS. 1 and 2. It should be noted that channel 30A may alternatively be positioned outside of the vessel with suitable inlets and outlets connected to the inside of the vessel. Channel 30A may be positioned within the vessel at any of various points such as at the periphery of the vessel. Channel 30A includes a plurality of vertically spaced apart openings 33. Each of the openings 33 includes a baffle 36 mounted therein. In the embodiment of FIG. 3, this baffle is a fixed element which extends into the interior of channel 30A. As is generally known in the prior art, when material is filled in vessel 10 to a given level, material will flow into a downcomer channel like 30A but without baffles primarily through the top-most opening 33 which is below the level of material and little or no material will flow into an opening below that top-most opening. If a baffle element such as that illustrated at 36 is positioned in a lower opening 33, then material will flow into channel 30A not only from the uppermost opening 33 but also from a next lower opening that includes a baffle element 36. Thus, if the level of material in the vessel is at 100, material will flow into upper opening 33*a*. Without the use of baffles 36, very little, if any, material will flow into the lower openings 33*b* to 33*e*. If baffles 36 are placed in each opening 33, when material is at level 100, material will flow into not only the top opening 33*a* but also the lower openings 33*b*–33*e*. When the material level drops to 101, then material will flow into opening 33*b* and into baffled openings 33*c*–33*e*.

Baffle elements 36 can be made movable to enable control of the amount of flow into channel 30A as well as the position from which material flows into that channel. Copending U.S. application Ser. No. 848,005, filed Apr. 3, 1986, the subject matter of which is herein incorporated by reference, illustrates a movable baffle 36.

Figure 4:
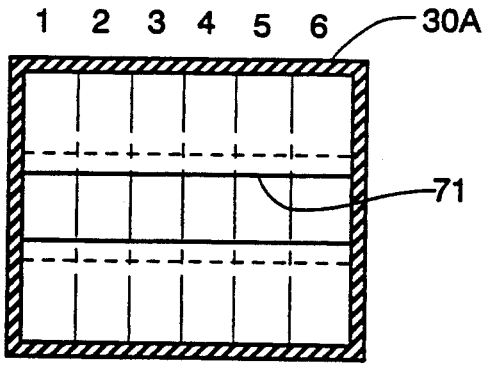
FIG. 4 is a sectional view along Section IV—IV of FIG. 3.

Channel 30A includes a plurality of ports or openings 33a–33e and a baffle 36 associated with each port or opening 33a–33e. Baffles 36 each extend across a portion of the flow area within channel 30A to produce rectangular flow striations as shown in FIG. 4. These striations are produced by the following phenomenon. Material which enters at the location at the top portion 31 of channel 30A is pushed to the right within channel 30A when it encounters a baffle 36 at port 33a. Material entering at port 33a will fill the area below baffle 36 at port 33a. When the material flow encounters baffle 36 at port 33b, this material will be pushed to the right within channel 30A and the material entering at port 33b will fill the area below the baffle at 33b. This process continues sequentially until the portion of channel 30A below port 33e is reached. At this point the striated flow configuration of FIG. 4 is present. It is noted that, e.g., if each baffle 36 extends halfway across the channel, striation 1 originating at 33e in FIG. 4 will cover 50% of the total discharge flow area, striation 2 originating at 33d 25% of the same, striation 3 originating at 33c 12.5% of the same, striation 4 originating at 33b 6.25%, striation 5 originating at 33a 3.125%, and striation 6 originating at top portion 31 3.125%. It should be further noted that the relative sizes of the various flow striations can be controlled by modifying the degree to which the various baffles 36 extend into channel 30A.

As shown in FIG. 3, a discharge spout or conduit means 70 directs a portion of the material flow via conduit 72 to the lower end of the vertical vessel and into a seal leg for recycling and directs another portion of the material flow via conduit 71 as continuous discharge. FIG. 4 shows a sectional view of rectangular conduit 71 which extends across all of the material flow striations 1–6 to provide a well-blended discharge. It should be noted that, while channel 30A has been illustrated as rectangular, a square channel, a circular channel or a channel having other alternative shapes could be employed.

In operation of the blender according to the present invention, material is supplied from the source through conveying line 4 and the energy used to supply material to the blending vessel up through inlet 13 also conveys material up lift column 20 where it spills out of top outlet 23 of column 20 in a geyser-like manner into the top of vessel 10. Material which is in the vessel fills tubular extension 12 and is entrained in the gaseous fluid under pressure conveying fresh material from source 2 whereby the material already in the vessel is also conveyed up lift column 20 to thereby blend material already in the vessel with fresh material being supplied to the vessel. Of course, if there is no fresh material being supplied through conduit 4, air under pressure is supplied through conduit 4 up through column 20 to entrain material already in the vessel up through column 20 to circulate material through the vessel to achieve blending. Blending is improved if recirculation of material from the upper regions of the vessel is supplied for entrainment with fresh material being supplied to the vessel. In order to accomplish this, at least one, but generally a plurality of, recirculation channels are added to supply material from the upper part of the vessel to the lower part of the vessel. In order to properly mix the material already in the vessel with incoming feed material and with material discharged from the outlets of the recirculation channels, it is necessary to provide a seal between the lower end of lift column 20 and the inside of vessel 10. Tubular extension 12 together with the lower end of lift column 20 define a seal leg 50. Column 20 and tubular extension 12 are dimensioned to define a seal leg to enable a major portion of the gaseous fluid under pressure being supplied through inlet 13 to be directed upwardly through lift column 20. If the seal leg is not utilized, material will bridge at the bottom of the blender cone and substantially no material will be recycled from the inside of the vessel up through column 20.

Figure 5:
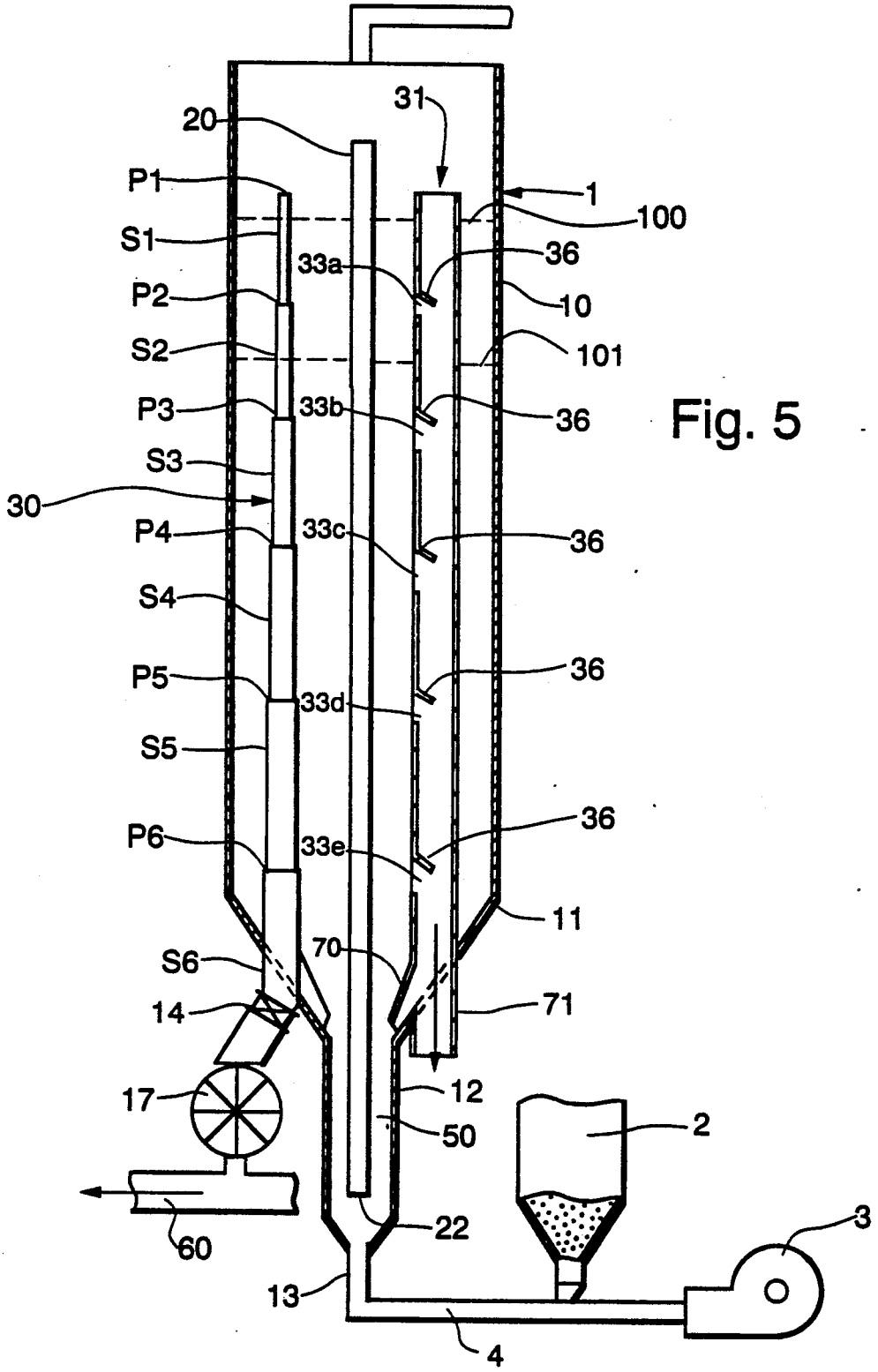
FIG. 5 is a sectional view of a third embodiment of the present invention.

FIG. 5 illustrates a blender 1 having both a channel 30 in accordance with the FIG. 2 system and a channel 30A in accordance with the FIG. 3 system. The combination of two different types of channels 30 and 30A significantly enhances the blending effect as follows. Regarding a channel 30A, if all baffles 36 at ports 33a–33e extend halfway across the channel, and if it is assumed that the flow rate below port 33e is 10 feet minute (fpm) the flow between ports 33e and 33d will be 5 fpm, that between ports 33d and 33c 2.5 fpm, that between ports 33c and 33b 1.25 fpm and that between ports 33b and 33a 0.625 fpm. On the other hand, regarding a channel 30, if it is assumed that the flow rate below port P6 is 10 fpm, the flow rate at all sections of channel 30 will also be 10 fpm. As a result of the above, the amount of time required for material entering, for example, at uppermost port 33a of channel 30A to reach the outlet at the bottom of channel 30A will be substantially greater than the time required for material entering uppermost port P2 of channel 30 to reach the outlet at the bottom of channel 30. It should be noted that ports 33a–33e can be positioned at the same or different elevations as ports P1–P6. This results in greater blending of the material within blender 1.

From the foregoing, it should be apparent that the objects of this invention have been carried out. An improved blender is provided which is capable of withdrawing product from a plurality of locations or elevations within the blender bed to more closely approach the performance of a perfect blender than would be the case with a system withdrawing product from a single vertical location within the blender bed. The invention also yields an improved blender which includes a withdrawal system employing a downcomer channel having vertical sections at least two of which have different flow areas. The different vertical sections can be structured to contribute approximately equal percentages of the total withdrawal flow or alternatively, contribute predetermined percentages which may be different for the various vertical sections in accordance with use requirements. In other words, the various sections of the withdrawal channel can have any desired flow areas to enable each section to contribute whatever percentage of the total withdrawal flow is desired. The invention also achieves an improved blender including a blending system employing both a downcomer channel having the above-noted capabilities in combination with another type of downcomer channel including a plurality of vertically spaced withdrawal ports and a baffle associated with each withdrawal port. The invention further provides a dual function recycle/withdrawal nozzle connected to the outlet of a downcomer channel.

It should be noted that the above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

I claim:

1. An apparatus for blending and withdrawing solid particulate material from a vessel, comprising:

a first downcomer channel, through which said material downwardly travels, associated with said vessel and including an outlet at a bottom portion thereof, said first channel comprising n successive vertical sections and n flow ports through which said material enters said first downcomer channel respectively located at top portions of said n sections, at least two of said n sections having flow areas different in size from one another, wherein material that travels downward through said first downcomer channel will pass through the flow area of any of said sections located beneath the section into which said material first entered said downcomer channel.

2. The apparatus as in claim 1, wherein all of said n sections have cross sectional internal flow areas different in size from one another.

3. The apparatus as in claim 1, wherein said n sections have cross sectional internal flow areas which are progressively smaller from a bottommost to a topmost one of said n sections.

4. The apparatus as in claim 3, wherein said n sections comprise means for providing a volumetric outlet flow rate at said outlet of said first channel which includes a flow rate contribution from each of said n sections which is 1/n of said outlet flow rate.

5. The apparatus as in claim 3, wherein a bottommost one of said n sections has an internal flow area A, and each subsequent vertical one of said n sections has an internal flow area smaller by A/n than a below adjacent one of said n sections.

6. The apparatus as in claim 1, further comprising a second downcomer channel associated with said vessel and including a plurality of vertically spaced inlets for receiving particulate material from said different vertical locations within said vessel and an outlet at a bottom portion thereof, each of said inlets of the second channel including a baffle means extending into an internal flow area of said second channel.

7. The apparatus as in claim 6, further comprising a conduit means in fluid communication with said outlet of said second channel comprising means for directing a portion of said particulate material at said outlet to said lower part of said vessel and means for withdrawing another portion of said particulate material at said outlet to a conveying line outside said vessel.

8. The apparatus as in claim 7, wherein said conduit means comprises a first rectangular conduit positioned to receive material from said outlet of said second channel, said means for withdrawing comprises a second rectangular conduit connected to said first conduit to intercept particulate material flowing down said first conduit along a section extending from one side to an opposite side of said first conduit in a direction which is substantially the same as a direction in which said baffle means extend into said second channel, and said means for directing comprises a third rectangular conduit connected to said first conduit to intercept a remaining portion of said particulate material to recycle it to said lower part of said vessel.

9. The apparatus as in claim 6, further comprising a conduit means in fluid communication with said outlet of said first channel comprising means for directing a portion of said particulate material at said outlet to said lower part of said vessel and means for withdrawing another portion of said particulate material at said outlet to a conveying line outside said vessel.

10. The apparatus as in claim 9, wherein said conduit means comprises a first rectangular conduit positioned to receive material from said outlet of said second channel, said means for withdrawing comprises a second rectangular conduit connected to said first conduit to intercept particulate material flowing down said first conduit along a section extending from one side to an opposite side of said first conduit in a direction which is substantially the same as a direction in which said baffle means extend into said first channel, and said means for directing comprises a third rectangular conduit connected to said first conduit to intercept a remaining portion of said particulate material to recycle it to said lower part of said vessel.

11. An apparatus for blending and withdrawing solid particulate material, comprising:

a vertically oriented vessel having an upper part, a lower part, an inlet for particulate material to be blended, an outlet for blended particulate material and a tubular extension at said lower part, a vertical lift column (i) centrally mounted in said vessel, (ii) having a lower part extending into said tubular extension, and (iii) including an inlet within said tubular extension and an outlet in the upper part of the vessel, means for supplying gaseous fluid under pressure to said tubular extension below said lift column for entraining material in the tubular extension into the inlet of the lift column and upwardly through the lift column whereby material is discharged from the outlet of said lift column in a geyser-like manner into the upper part of the vessel, said tubular extension and the lift column being dimensioned to define a seal leg to enable a major portion of said gaseous fluid to be directed upwardly through the lift column, and a first downcomer channel through which said material downwardly travels associated with said vessel and having an outlet at a bottom portion thereof, said first channel comprising n successive vertical sections and n flow ports through which said material enters said first downcomer channel respectively located at a top portion of said n sections, at least two of said n sections having flow areas different in size from one another, wherein material that travels downward through said first downcomer channel will pass through the flow area of any of said sections located beneath the section into which said material first entered said downcomer channel.

12. The apparatus as in claim 11, wherein all of said n sections have cross sectional internal flow areas different in size from one another.

13. The apparatus as in claim 11, wherein said n sections have cross sectional internal flow areas which are progressively smaller from a bottommost one to a topmost one of said n sections.

14. The apparatus as in claim 13, wherein said n sections comprise means for providing a volumetric outlet flow rate at said outlet of said first channel which includes a flow rate contribution from each of said n sections which is 1/n of said outlet flow rate.

15. The apparatus as in claim 11, further comprising a second downcomer channel associated with said vessel and including a plurality of vertically spaced inlets for receiving particulate material from said different vertical locations within said vessel and an outlet at a bottom portion thereof, each of said inlets of the second channel including a baffle means extending into an internal flow area of said second channel.

16. The apparatus as in claim 15, wherein a bottommost one of said n sections has an internal flow area A, and each subsequent vertical one of said n sections has an internal flow area smaller by A/n than a below adjacent one of said n sections.

17. The apparatus as in claim 15, further comprising a conduit means in fluid communication with said outlet of said second channel comprising (i) means for directing a portion of said particulate material at said outlet to said lower part of said vessel and (ii) means for withdrawing another portion of said particulate at said outlet to a conveying line outside said vessel.

18. The apparatus as in claim 17, wherein said conduit means comprises a first rectangular conduit positioned to receive material from said outlet of said second channel, said means for withdrawing comprises a second rectangular conduit connected to said first conduit to intercept particulate material flowing down said first conduit along a section extending from one side to an opposite side of said first conduit in a direction which is substantially the same as a direction in which said baffle means extend into said second channel, and said means for directing comprises a third rectangular conduit connected to said first conduit to intercept a remaining portion of said particulate material to recycle it to said lower part of said vessel.

19. The apparatus as in claim 15, further comprising a conduit means in fluid communication with said outlet of said first channel comprising (i) means for directing a portion of said particulate material at said outlet to said lower part of said vessel and (ii) means for withdrawing another portion of said particulate at said outlet to a conveying line outside said vessel.

20. The apparatus as in claim 19, wherein said conduit means comprises a first rectangular conduit positioned to receive material from said outlet of said first channel, said means for withdrawing comprises a second rectangular conduit connected to said first conduit to intercept particulate material flowing down said first conduit along a section extending from one side to an opposite side of said first conduit in a direction which is substantially the same as a direction in which said baffle means extend into said second channel, and said means for directing comprises a third rectangular conduit connected to said first conduit to intercept a remaining portion of said particulate material to recycle it to said lower part of said vessel.

21. A method of blending and withdrawing solid particulate material from an apparatus which includes a downcomer channel means including a first downcomer channel through which said material downwardly travels, having n successive vertical sections and n flow ports through which said material enters said first downcomer channel respectively located at top portions of said n sections, wherein material that travels downward through said first downcomer channel will pass through the flow area of any of said sections located beneath the section into which said material first entered said downcomer channel, said method comprising providing an outlet flow from said channel including predetermined percentage contributions from said n sections.

22. The method as in claim 21, further comprising causing said n sections to contribute approximately equal percentages of said outlet flow from said channel.

23. The method as in claim 21, wherein said downcomer means further comprises a second downcomer channel and said method further comprises moving particulate material down said first channel and said second channel from the same starting elevation at different speeds so as to enhance blending within said apparatus.

* * * * *